US011255057B2

(12) United States Patent
Gallagher

(10) Patent No.: US 11,255,057 B2
(45) Date of Patent: Feb. 22, 2022

(54) SCREED ASSEMBLY FOR ROAD PAVING MACHINES, AND A METHOD FOR REPAVING ROAD SURFACES

(71) Applicant: Brian Gallagher, Thornton, IL (US)

(72) Inventor: Brian Gallagher, Thornton, IL (US)

( * ) Notice: Subject to any disclaimer, the term of this patent is extended or adjusted under 35 U.S.C. 154(b) by 60 days.

(21) Appl. No.: 16/812,273

(22) Filed: Mar. 7, 2020

(65) Prior Publication Data

US 2021/0277609 A1 Sep. 9, 2021

(51) Int. Cl.
*E01C 19/48* (2006.01)
*E01C 19/10* (2006.01)
*E01C 19/42* (2006.01)

(52) U.S. Cl.
CPC ..... *E01C 19/1063* (2013.01); *E01C 19/42* (2013.01); *E01C 19/48* (2013.01); *E01C 2301/14* (2013.01)

(58) Field of Classification Search
CPC ..... E01C 19/42; E01C 19/48; E01C 19/1063; E01C 2301/14
USPC ..... 404/17–118
See application file for complete search history.

(56) References Cited

U.S. PATENT DOCUMENTS 3,285,148 A * 11/1966 Munyon ..... E01C 19/008 404/84.2
3,559,544 A * 2/1971 Miller ..... E01C 19/42 404/96
5,439,313 A * 8/1995 Blaha ..... E01C 19/46 404/101

(Continued)

FOREIGN PATENT DOCUMENTS

CN 102787545 11/2012
CN 102926313 2/2013

(Continued)

*Primary Examiner* — Raymond W Addie
(74) *Attorney, Agent, or Firm* — Law Offices of Steven W. Weinrieb

(57) ABSTRACT

A new and improved method and apparatus for use in conjunction with the free floating paving screed used for road paving is disclosed. The method of forming a bituminous mixture into a smooth flat paved mat comprising some areas with a given nominal mat density and some selected areas with a predeterminedly higher mat density is described wherein problems posed by a reduced compaction ratio occurring subsequently to paving the mat where the roller drum bridges over recesses in the subbase are addressed. The modified paving screed described employs a new adjustable screed plate that allows localized areas of increased angle of attack and a device to increased material entry density in localized areas in front of a screed plate leading edge. Either method is used to create an increase in mat density in the desired area. The method and apparatus teach that by pairing differences in compaction ratio that inherently occur due to subbase irregularities with correspondingly predetermined and different mat densities in the paved mat, a good consistent final density can be achieved notwithstanding the limitations of the compaction rolling. A forward looking vision system is described that identifies subbase recesses, a digital controller quantifies the density increase required, and a GPS system maps locations where the mat density increases are to be applied.

21 Claims, 6 Drawing Sheets

(56) References Cited

U.S. PATENT DOCUMENTS 5,721,685 A * 2/1998 Holland ..... E01B 35/02 342/357.31
5,735,634 A * 4/1998 Ulrich ..... E01C 19/48 404/102
5,803,661 A * 9/1998 Lemelson ..... E01C 23/07 299/41.1
5,868,522 A 2/1999 Campbell
6,158,921 A 12/2000 Holmes
6,273,636 B1 * 8/2001 Johanpeter ..... E01C 19/4893 404/104
6,287,048 B1 * 9/2001 Hollon ..... E01C 19/006 404/104
6,890,125 B1 5/2005 Calder et al.
6,939,079 B2 * 9/2005 Lloyd ..... E01C 23/065 404/90
6,952,487 B2 * 10/2005 Patton ..... G01C 11/02 252/301.19
7,198,429 B2 * 4/2007 LeJeune ..... B28B 1/29 404/118
7,651,295 B2 1/2010 Eppes et al.
8,221,026 B2 * 7/2012 Munz ..... E01C 19/48 404/96
8,356,957 B2 * 1/2013 Weiser ..... E01C 19/48 404/84.05
8,591,145 B1 11/2013 Engel et al.
8,827,591 B2 * 9/2014 Begley ..... B65D 88/54 404/84.1
8,998,530 B2 4/2015 Buschmann et al.
9,033,611 B2 * 5/2015 Hanfland ..... G01B 21/08 404/84.1
9,212,458 B2 12/2015 Kappel
10,428,472 B1 * 10/2019 Worsley ..... E01C 19/006
2009/0080973 A1 * 3/2009 Bespalov ..... G08G 1/0129 404/72
2010/0189498 A1 * 7/2010 Doherty ..... G08G 1/096811 404/72
2016/0032540 A1 * 2/2016 Reda ..... E01C 19/004 404/75

FOREIGN PATENT DOCUMENTS

CN 104099216 10/2014
CN 106801374 6/2017
CN 106835903 6/2017
CN 206599716 10/2017
CN 206607479 11/2017
CN 109680589 4/2019
EP 2377998 10/2011
JP 2014-62432 4/2014
WO WO 2009036779 3/2009
WO WO 2014/026452 2/2014

* cited by examiner

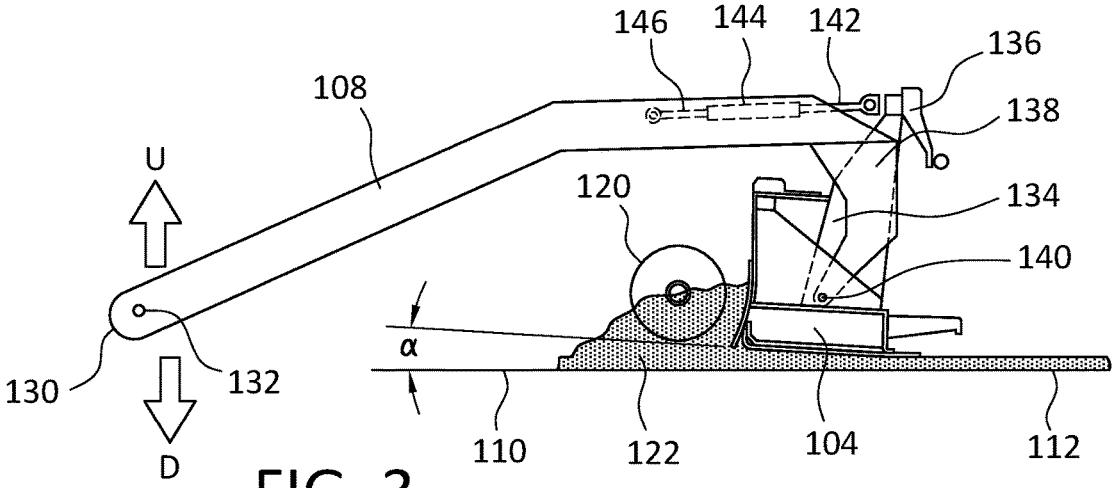
FIG. 3
PRIOR ART
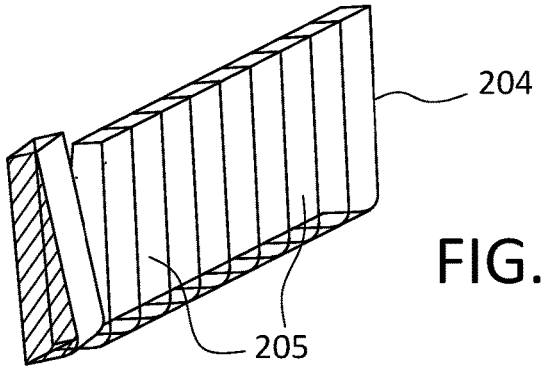
FIG. 4
FIG. 5
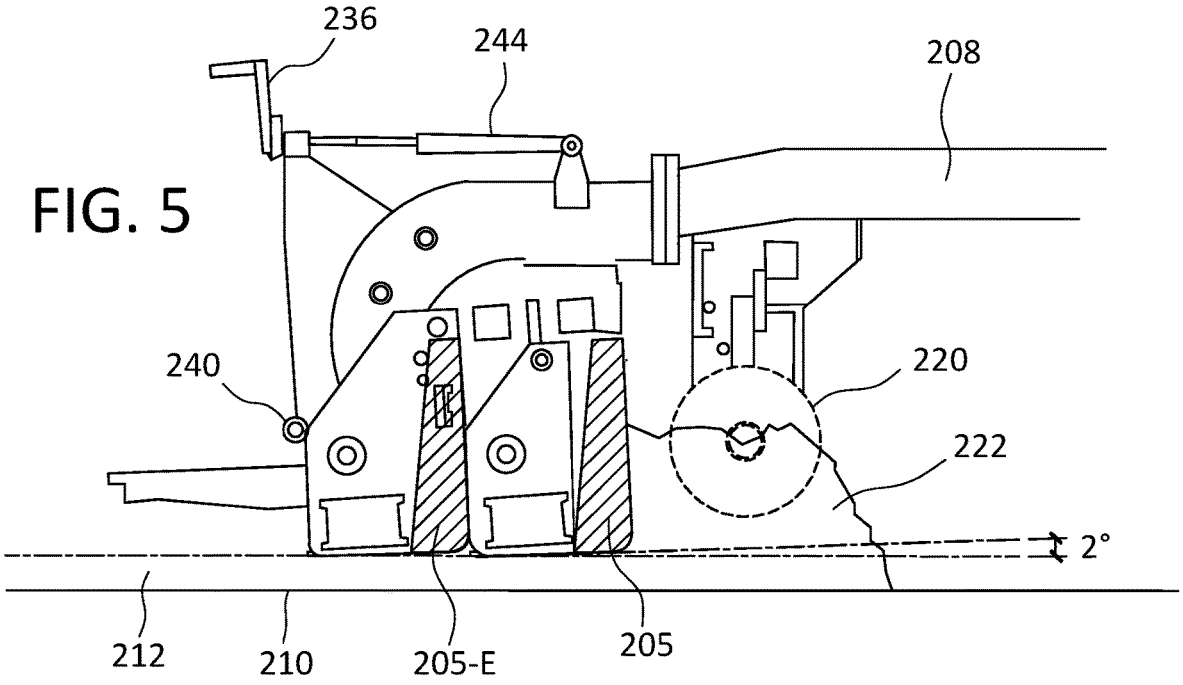

SCREED ASSEMBLY FOR ROAD PAVING MACHINES, AND A METHOD FOR REPAVING ROAD SURFACES

FIELD OF THE INVENTION

The present invention relates generally to road pavers or paving machines, and more particularly to a new and improved floating screed of the road paving machine, and a method of using the same, which can automatically provide the required mat density of road paving material required at predetermined locations of the road surface so as to, for example, provide for extra or additional mass of road paving material to be placed within various different parts or locations of the road surface where compaction is commonly hindered by variations in the sub-base which may contain, for example, various depressions, ruts, tracks, potholes, or the like, such that the new, repaved resulting road will effectively have a smooth surface and will also exhibit a consistent density characteristic after completion of the compaction rolling operation throughout the entire repaved resulting road surface including those regions having depressions, ruts, tracks, potholes, or the like originally formed therein.

BACKGROUND OF THE INVENTION

Asphalt pavers or paving machines for laying down or forming mats of asphalt material upon, roadways, parking lots, and the like, are of course well known. A state-of-the-art asphalt paver or paving machine usually comprises a tractor unit with an asphalt storage hopper in the front, and a paving screed that it pulls behind it that applies asphalt material to the surface being paved. The paver receives material to its hopper by a periodic series of dump trucks that back up to its hopper one at a time to transfer material to the paver during the paving operation. The paver continuously conveys that material rearward from its storage hopper, to where the material drops in the center of the paving screed. Said material is displaced outward to the left & right end gates of the screed by means of augers, to form an even, uniform pile across the entire screed. The material in front of the screed is known as the head of material. When repaving a particular roadway or parking lot, sometimes the roadway or parking lot to be repaved will initially be milled so as to effectively remove the original asphalt so as to expose an original base surface or foundation whereby the new asphalt, constituting the new roadway or parking lot, will then be deposited atop the original base surface or foundation. Alternatively, since the milling process adds additional cost, the milling operation will not be performed and the new or repaved roadway or parking lot will simply be deposited atop the old or original roadway or parking lot. In the case where milling has been performed and the old or original roadway or parking lot has been removed, the resulting base surface or foundation is oftentimes not in fact smooth, and often has irregular surface portions defined therein which are known as scabs. In the case where milling has not been performed, the old or original base surface or foundation will normally have various depressions, ruts, tracks carved into them by means of, for example, trucks or other heavy machinery which have been driven over the roadway or parking lot, or potholes which have developed over time due to exposure to drastically variable environmental or weather conditions.

As has been previously noted, trucks are utilized in conjunction with the paving machine so as to continuously supply asphalt material to the paving machine. In turn, the paving machine, by means of the paving screed, is capable of depositing a layer of asphalt material over the roadway or parking lot surface to be repaved such that the layer of the deposited asphalt material or paved mat will have specified or predetermined width and thickness dimensions as well as an initial degree of compactness or density. As is also well known, after the paver or paving machine effectively deposits and forms the new section of the roadway or parking lot surface comprising the newly deposited asphalt material having the specified or predetermined width and thickness dimensions, the newly deposited asphalt material will subsequently be subjected to compaction by means of a series of conventional compaction rollers. Smoothness and adherence to the underlying base surface or foundation comprising the roadway or parking lot, as well as attainment and uniformity of the required degree of compactness or final density of the newly paved mat comprising the new roadway or parking lot surface, are critically important factors such that the newly paved mat will be provided with sufficient durability and structural integrity. In this manner, the newly paved mat will last over a relatively long period of time, thereby effectively eliminating the necessity to repave the roadway or parking lot at more frequent intervals, which, of course, is very time-consuming and very costly, especially to local governments or businesses responsible for the maintenance of the roadways or parking lots.

More particularly, after the asphalt mat has been laid by the paving screed, the compaction rolling of the asphalt mat involves repeated passes of rollers over the asphalt surface until the targeted density has been achieved. This repeated application of a series of rollers over the mat causes individual stones in the paving mix to press together more tightly with each successive rolling pass. The amount of compaction increases with each roller pass while, simultaneously, the height of the paved mat diminishes with each roller pass until the new pavement exhibits both the final required thickness and the final target density. In order to achieve both of these targeted end results, the screed must be properly set to lay a height of material in excess of the desired final thickness, such that after rolling, the mat is compressed to the required final thickness while it simultaneously attains the final required density. It is well known in the art that typical asphalt mixes require, for a particularly desired final thickness, a laid-down thickness in excess of the desired thickness, in order to allow for the reduction in thickness caused by means of the roller compaction. Many common mixes used in the industry compact down to their final desired density and thickness when the screed is adjusted to pave a mat that has for example, a height close to 125% of the final desired thickness. It can be readily appreciated that the conventional paving screed, whether paving over planar surfaces, or over bumps or recesses, lays down a mat comprising a generally fixed, consistent density over the entirety of the paved mat. For typical mixes that will attain the desired density and thickness when laid at a thickness that is 125% of the desired final thickness, it can further be readily understood that the density of such a newly laid mix by the paving screed can be calculated to have a density that is 75% of its maximum density before rolling. As is also known in the art, density, when expressed as a percentage, refers to the density of an asphalt mix sample divided by the maximum theoretical density of the component parts or stones comprising that sample.

The asphalt paving screed conventionally used in the industry is known as a free-floating screed. It is towed by the paving tractor which is feeding it a steady stream of new asphalt, and it is free-floating over the asphalt material, the weight of the screed being supported only by the force and stability of the asphalt mix that is flowing from front to back, under its bottom screed plate and exiting at its rear edge. The free-floating screed produces a smooth flat mat surface as the screed rides over high spots, and fills in lower areas of the road base as it travels along the desired path. The ability to freely float over the subbase and over the material it is laying down is the best method known in the art to pave a new surface over both smooth planar, or rough uneven sub-bases. The screed, by use of a flat steel bottom plate called a screed plate, floats over the material being laid by employing a slight upward angle of the screed plate, as measured from front to back, wherein this angle is known as the angle of attack. During forward travel, the screed effectively hovers at the desired paving thickness while its weight is supported by the resistance of the asphalt material flowing under the screed plate. The semi-fluid material flowing under the screed plate is subjected to a compaction or extrusion force as its thickness is reduced from the slightly greater thickness at its entry point at the front edge of the screed plate, to a lesser thickness at the trailing edge of the screed plate. If the angle of attack of the entire screed plate is increased, the screed will ride up to a greater height, or paving thickness, until a point at which the weight of the screed and the reactant force of the extrusion process occurring below the screed again reach equilibrium. As a consequence of the extrusion process, the screed imparts into the newly laid mat a degree of compaction which can be measured as the newly laid mat's density. For any representative sample or volume within the paved mat, the corresponding mass can be measured, and expressed as the density, wherein density is equal to the mass of the material divided by the volume of the material and is commonly expressed in pounds per cubic foot.

It can be readily understood that the asphalt material that comprises the paved mat that is laid down over all areas of the sub-base, that is, both the planar and recessed areas, is laid down by the screed in or with one generally consistent density. Subsequently, the compaction rollers will increase the density of the laid mat to the higher targeted final density by compacting and displacing the mat surface vertically downwardly. Where the objectives are to pave a road with a smooth surface and desired final density, conventional free floating screeds work well when applying a substantially planar new mat over a substantially planar old sub-base. However, instances within which conventional free-floating screeds fail in these objectives are those areas comprising non-planar sub-bases, and such failures are typically not realized until later, after the rolling operations have been completed. More particularly, when paving a smooth flat mat over a smooth planar sub-base, the compaction rollers will typically compress the material equally over all areas, and there will be nothing preventing the roller drum from displacing the mat surface downwardly within all areas of the mat equally. Therefore, these areas with a smooth planar sub-base can end up with paved overlays having both good final density and good surface smoothness characteristics after rolling.

However, when paving a smooth flat mat over a sub-base with large, wide uneven lower regions, or those sub-bases which may contain bumps, ruts, and recesses, while the compaction rollers might successfully fully compact the asphalt placed over the wide recessed areas as long as the roller drums are able to ride the newly paved surface down into such wide recesses, in doing so, undesired new recesses may be formed within those same areas, that is, within the newly compacted pavement. These areas could likely have good final density, but poor surface smoothness after rolling. Alternatively, under such or similar conditions, rollers will fail to fully compact smaller recessed areas if such smaller recessed areas measure in width which is less than the width of the roller drum. In these areas of small recesses in the sub-base, the compaction roller drum will be supported by means of the planar areas above and around the recessed area, and will thus be prevented from fully compressing and sufficiently compacting such small recessed areas. The higher areas above and around the recessed area will firm up, reach final density, and effectively hold the roller drum from any further downward displacement into the adjacent recessed areas, before proper compaction is achieved within the recessed areas. This common phenomenon is known in the industry as roller bridging. These areas are therefore highly likely to have poor final density, but good surface smoothness after rolling. In turn, this area of poor density is likely to later result in localized pavement failure such as a pothole.

The aforementioned problems of the conventional paving process are well known in the industry. The state-of-the-art compaction rollers cannot overcome the above described limitations of today's paving screeds, nor can state of the art paving screeds overcome the above described limitations of today's compaction rollers, when such apparatus or machinery is used for paving over nonplanar subbases. This problem can be solved by accepting that the roller drum can only vertically displace or compact the pavement surface until a point at which it firms up the pavement in the planar areas of the sub-base, at which point the roller drum will effectively be held up, in accordance with the aforenoted roller bridging phenomena, and thereby prevented from compacting the newly laid asphalt material any further into the deeper adjacent recessed areas. Instead, we propose to supplement the mass or density of the material of the mat laid over the recessed areas, such that the requisite extra mass of material placed over the recessed areas equals the amount that will in fact achieve good final density in accordance with the amount of vertical roller effectively delivered to the other planar areas of the paved mat around it. As can be readily understood, due to the fixed available volume defined between the sub-base at the bottom, and the mat's smooth top surface as applied by the floating screed, the additional material to be added to the mat must be applied by means of laying a mat of increased density over the recessed areas. This can be readily appreciated from the well-known definition of Density wherein Density (D)=Mass (M)/Volume (V). Accordingly, by increasing the Mass M within a particular Volume V comprising the area over the recess, and bounded at the bottom of the recess up to the surface of the paved mat at the top, the Density D is increased such that the Density D of the mat above the recessed area will effectively be greater than the Density D over the non-recessed or planar areas where the Mass M of the asphalt material has not been accordingly increased by a predetermined amount.

For explanation and understanding or comprehension purposes, it is important to understand the Ratio of Compaction:

When a screed lays down a mat of, for example, 2.5" thick, it is subsequently rolled down to a thickness of 2.0". The screed lays down the mat at a typical initial density of 75.0%. In this case, let us assume that there is nothing that will prevent the roller drum from displacing the entire surface downwardly as needed. Therefore, calculating the ratio of compaction, we have (2.5"−2.0")/2.0"=0.25 which is the ratio of compaction within the flat planar regions or areas. Using this ratio of compaction, along with the initial laid-down density of 75%, we can calculate that such an area would therefore attain a good, desired, finalized density of 93.75%.

To the contrary, now let us assume that there is a small recess present within the sub-base that is 0.5" deep, and let us assume further that the roller will bridge across the top of the recess during the rolling or compaction process. Once again, the screed lays a mat at an initial density of 75.0%. In this instance the 2.5" thickness of mat material is now 3.0" over the recess, and the recessed area is now rolled down to a 2.5" thickness. Therefore, calculating the ratio of compaction we have (3.0"−2.5")/2.5"=0.20 which is the ratio of compaction within the area of the recess due to the roller bridging. Using this ratio of compaction, along with the initial laid density of 75.0%, we now calculate that such an area would have a finalized density of only 90.00%.

Alternatively, we can calculate that by laying down a mat with an intentionally greater amount of material or density of for example, 77.50% over the areas of the 0.5" deep recesses, our calculation shows that we will achieve a finalized density of 93% within the recessed area where the ability to compact is limited to the lesser value of compaction ratio of 0.20. It can be further understood that for any value of compaction ratio, there is a corresponding value of lay-down density that will produce the desired final density. Correspondingly, for every measure in recess depth adjacent a planar area, a calculable corresponding value of lay-down density that will produce the desired final density, given any rolling restrictions that might influence the compaction ratio, can be calculated.

A need therefore exists in the art for a new and improved screed assembly to be utilized in conjunction with roadway or parking lot pavers or paving machines. Another need exists in the art for a new and improved screed assembly to be utilized in conjunction with roadway or parking lot pavers or paving machines wherein the aforenoted difficulties or problems encountered when repaving roadways or parking lots utilizing conventional screed apparatus can be overcome. Still another need exists in the art for a new and improved screed assembly to be utilized in conjunction with roadway or parking lot pavers or paving machines wherein the screed implement can effectively deposit different predetermined mat densities of asphalt material onto underlying regions of a roadway or parking lot. Yet another need exists in the art for a new and improved screed assembly to be utilized in conjunction with roadway or parking lot pavers or paving machines wherein the screed implement can effectively deposit different predetermined mat densities of asphalt material onto underlying regions of a roadway or parking lot such that regardless of whether or not a particular underlying region of the roadway or parking lot contains a depression, rut or track, or pothole, the resulting final density of the repaved roadway or parking lot will be uniform throughout all regions thereof and the repaved surface will be smooth, and the ride quality of the road will be improved. An additional need exists in the art for a new and improved screed assembly to be utilized in conjunction with roadway or parking lot pavers or paving machines wherein the screed assembly can effectively deposit different predetermined mat densities of asphalt material onto underlying regions of a roadway or parking lot such that regardless of whether or not a particular underlying region of the roadway or parking lot contains a depression, rut or track, or pothole, the resulting final density of the repaved roadway or parking lot will be uniform throughout all regions thereof whereby the structural integrity of the repaved roadway or parking lot will be enhanced. A further need exists in the art for a new and improved screed assembly to be utilized in conjunction with roadway or parking lot pavers or paving machines wherein the screed assembly can effectively deposit different predetermined mat densities of asphalt material onto underlying regions of a roadway or parking lot such that regardless of whether or not a particular underlying region of the roadway or parking lot contains a depression, rut or track, or pothole, the resulting density of the repaved roadway or parking lot will be uniform throughout all regions thereof whereby the structural integrity and durability of the repaved roadway or parking lot will be enhanced, thereby eliminating the need to frequently repave the roadway or parking lot.

OVERALL OBJECTIVES OF THE INVENTION

An overall objective of the present invention is to provide a new and improved screed assembly to be utilized in conjunction with roadway or parking lot pavers or paving machines. Another overall objective of the present invention is to provide a new and improved screed assembly to be utilized in conjunction with roadway or parking lot pavers or paving machines wherein the aforenoted difficulties or problems encountered when repaving roadways or parking lots utilizing conventional screed apparatus can be overcome. Still another overall objective of the present invention is to provide a new and improved screed assembly to be utilized in conjunction with roadway or parking lot pavers or paving machines wherein the screed implement can effectively deposit different predetermined mat densities of asphalt material onto underlying regions of a roadway or parking lot. Yet another overall objective of the present invention is to provide a new and improved screed assembly to be utilized in conjunction with roadway or parking lot pavers or paving machines wherein the screed assembly can effectively deposit different predetermined mat densities of asphalt material onto underlying regions of a roadway or parking lot such that regardless of whether or not a particular underlying region of the roadway or parking lot contains a depression, rut or track, or pothole, the resulting final density of the repaved roadway or parking lot will be uniform throughout all regions thereof.

An additional overall objective of the present invention is to provide a new and improved screed assembly to be utilized in conjunction with roadway or parking lot payers or paving machines wherein the screed assembly can effectively deposit different predetermined mat densities of asphalt material onto underlying regions of a roadway or parking lot such that regardless of whether or not a particular underlying region of the roadway or parking lot contains a depression, rut or track, or pothole, the resulting final density and smoothness of the repaved roadway or parking lot, after rolling, will be uniform throughout all regions thereof whereby the structural integrity of the repaved roadway or parking lot will be enhanced. A further overall objective of the present invention is to provide a new and improved screed assembly to be utilized in conjunction with roadway or parking lot pavers or paving machines wherein the screed assembly can effectively deposit different predetermined mat densities of asphalt material onto underlying regions of a roadway or parking lot such that regardless of whether or not a particular underlying region of the roadway or parking lot contains a depression, rut or track, or pothole, the resulting final density of the repaved roadway or parking lot will be uniform throughout all regions thereof whereby the structural integrity and durability of the repaved roadway or parking lot will be enhanced, thereby eliminating the need to frequently repave the roadway or parking lot.

SUMMARY OF THE INVENTION

The method and apparatus of this invention proposes an enhancement to the conventional paving process and to the free-floating screed wherein, rather than paving a road surface with an asphalt mat comprising one fixed, constant material density throughout the width of the new mat over the subbase, we use the modified screed design of this invention or such other modification or add-on mechanical device that allows the paving screed or paving system to lay a mat comprising a variable range of increased densities across the width of the paver. These increased densities are applied within specific areas of the new mat where sub-base irregularities necessitate material of increased density to be laid in order to achieve proper finalized density and or good surface smoothness due to the fact that such areas will effectively receive a lower ratio of compaction than the other planar areas of the paved mat around it. The density of the newly paved mat laid down by the free-floating screed is influenced by various different factors. Two of these factors are a change in the density of the material entering the screed plate's leading edge, and a change in the screed plate's angle of attack This invention teaches a method of employing one or both of these two factors to affect an increase in density of the paved mat, in any desired location within the width of mat being paved.

The effects of changes to the density of the material, down at the bottom of the head of material and at the entry point of the screed plate's leading edge, are well known in the art. The material that enters the screed plate at the front is squeezed down to the height of the mat exiting at the rear. Whatever density this material exhibits at the entry point of the screed plate is increased by the extrusion process or height reduction occurring as the material flows under the screed plate. The density of the material at the entry of the screed plate's leading edge is important. The density of the newly laid mat is directly related to the following mathematical relationship, that is, the density of the material entering the screed plate, multiplied by the ratio of the screed plate's entry height divided by its exit height. A consistent head of material disposed in front of the screed is vitally necessary to maintain stability of the screed during the paving process. As can be understood, any change in either the width of the head of material, as measured from the front of the screed toward the pile's front edge, or in the height of the head of material, will change the magnitude of the force required by the screed to push the head of material in front of it as it travels forward. Looking at the screed in cross section, with a head of material piled in front of it, it can be understood that a wider pile and/or a higher pile both increase the pushing force needed to push the material forward. A typical screed might be dragging or pushing a pile of material in front of it weighing a few tons. Between the screed and the head of material, a vertical force component related to the height of the material, and a horizontal force component due to friction from the pile's resistance to being pushed, the resultant sum of these forces will be greatest down at the entry point at the leading edge of the screed plate, and as a result, material near the entry point will be under a resultant compressive force in this area. The degree of said compressive force directly influences the density of the material entering under the screed plate's leading edge. It can be further understood that an increase in the angle of attack increases the ratio of the entry height divided by exit height, causing more extrusion compaction which according to the above mathematical relationship, would also increase mat density. It should be noted that we propose these methods of increasing the angle of attack, or of using vertical augers to increase material entry density, to be used in specific, relatively narrow portions within the screed's total width at any one time. As either of these techniques would tend to make the screed rise to a greater paving thickness if applied over the majority of the screed's width, limiting deployment of our methods of increasing mat density to just a portion of the total width at any one time, would make any such tendency to rise, negligible.

As is conventional, the screed assembly may comprise a main screed assembly and a pair of side screed assemblies extending transversely outwardly from opposite sides of the main screed assembly. Accordingly, the new and improved screed assembly comprising the plurality of screed components or segments may also comprise the main screed assembly as well as both of the side screed assemblies. Each individual screed component or segment effectively has the configuration of a rectangular parallelepiped, may have a predetermined width dimension of, for example, six inches (6"), and is pivotally mounted at a lower rear edge portion thereof upon the screed assembly so as to be movable within a vertically oriented plane such that the angle of attack of the lower front edge portion of the undersurface portion of each one of the individual screed components or segments can achieve a predetermined forward-facing angle of attack. By adjusting the forward-facing angle of attack of any one of the screed components or segments, the amount of asphalt material effectively fed or conducted beneath that particular one of the screed components or segments can be varied while the lower rear edge portions of all of the undersurface portions of all of the individual screed components or segments collectively form the smooth upper surface of the newly paved roadway or parking lot.

The paving machine is also provided with a forward-looking vision system comprising at least a camera and a global positioning system (GPS) so as to be capable of visually detecting ruts, depressions, tracks, or potholes within the roadway or parking lot being repaved. The vision system detects areas of the sub-base that will experience roller bridging, lack of smoothness, and or density deficiencies during the rolling process, and the processor will effectively be instrumental in deploying particular ones of the plurality of screed components or segments by means of suitable fluid actuators which may be pneumatic or hydraulic actuators, in accordance with signals transmitted as a result of the detection of the depressions, ruts, tracks, or potholes, by means of the aforenoted forward-looking vision system, so as to alter the forward-facing angles of attack of the particular ones of the plurality of screed components or segments and thereby permit increased mat density to be deposited at predetermined times and locations onto the underlying roadway or parking lot in order to increase the mass of asphalt material, and thereby compensate for the lower value of compaction that will occur at the depression, rut, track, or pothole during the rolling operation such that it will ultimately exhibit a uniform target or finalized density. In addition to the aforenoted structural features of the present invention, a plurality of vertically oriented augers may also be respectively provided across the front of the screed assembly and may be used with or without the aforenoted movable screed segments such that when one or more selected augers are actuated, the augers can impart enhanced entry density to the head of the material in the required area at the screed's leading edge in order to increase mat density over the area of the rut, track, or pothole such that the area of enhanced mat density will allow the rollers to achieve the targeted finalized density and smoothness despite the lower value of compaction that will occur at said depression, rut, track, or pothole during the rolling operation.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein:

FIG. 3 is an enlarged schematic view of the conventional PRIOR ART screed assembly as attached to a tow truck by means of a pair of tow arms, only one of which is shown, and illustrating various different components of the paving machine which can be utilized to alter the angle of attack of the screed assembly with respect to the underlying road surface or parking lot;

FIG. 4 is a schematic perspective view of the new and improved screed assembly as constructed in accordance with the principles and teachings of the present invention wherein it is seen that the new and improved screed assembly comprises a plurality of screed components or segments wherein each component or segment has the configuration which is substantially that of a rectangular parallelepiped, the plurality of screed components or segments are disposed adjacent to each other and extend in a serial manner within a horizontally extending array, and wherein each one of the screed components or segments is independently movable in a pivotal manner by means of a pivotal connection located along the rear edge portion of each screed component or segment such that the angle of attack of the lower, forward edge portion of each screed component or segment can be adjusted as required or desired in order to effectively move a predetermined amount of asphalt material beneath that particular one of the plurality of screed components or segments, it being additionally noted that the first or leftwardmost one of the plurality of screed components or segment has been actuated such that it effectively has a greater angle of attack than the remaining screed components or segments;

FIG. 5 is a schematic, cross-sectional view of the new and improved screed assembly as disclosed within FIG. 4 showing the disposition of any one of the screed components or segments of the screed assembly when the particular one of the screed components or segments is disposed at an angle of attack, of for example, 2° with respect to the underlying road surface or parking lot;

DETAILED DESCRIPTION OF THE PREFERRED EMBODIMENT

Figure 1:
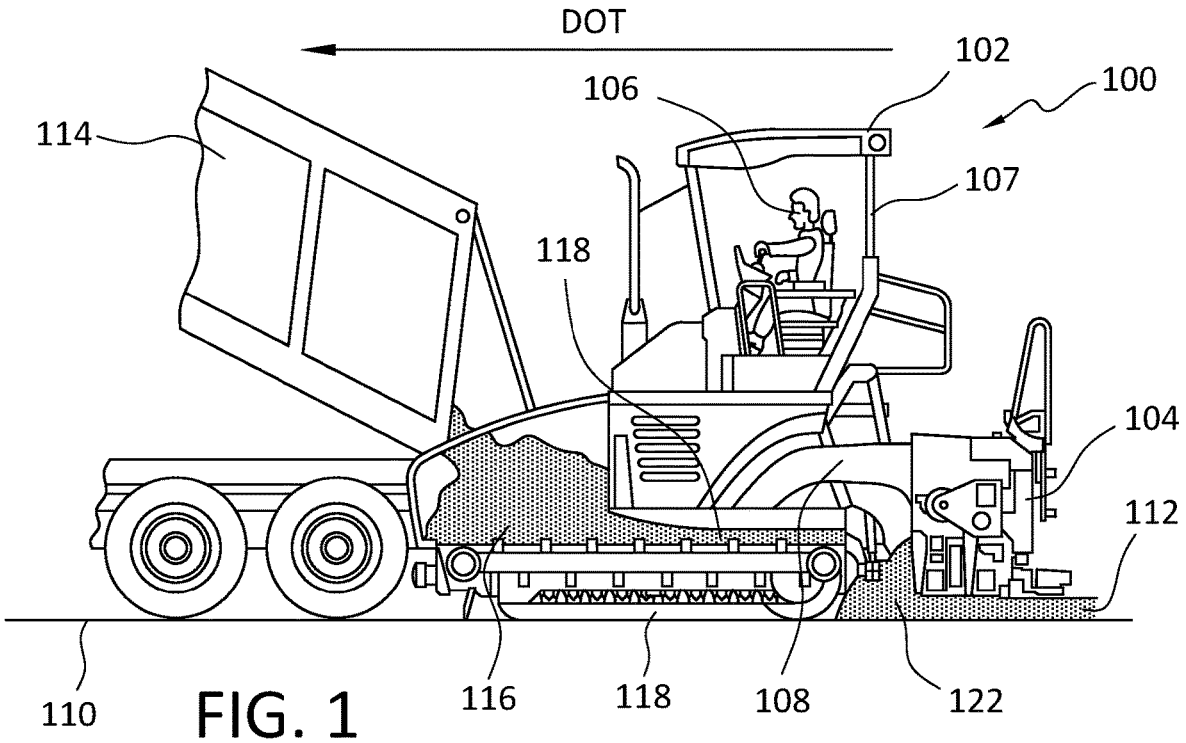
FIG. 1 PRIOR ART
FIG. 1 is a schematic side elevational view of a conventional, PRIOR ART asphalt supply truck and a paving machine to the rear end of which there is attached a screed assembly for paving a roadway or parking lot.
Figure 2:
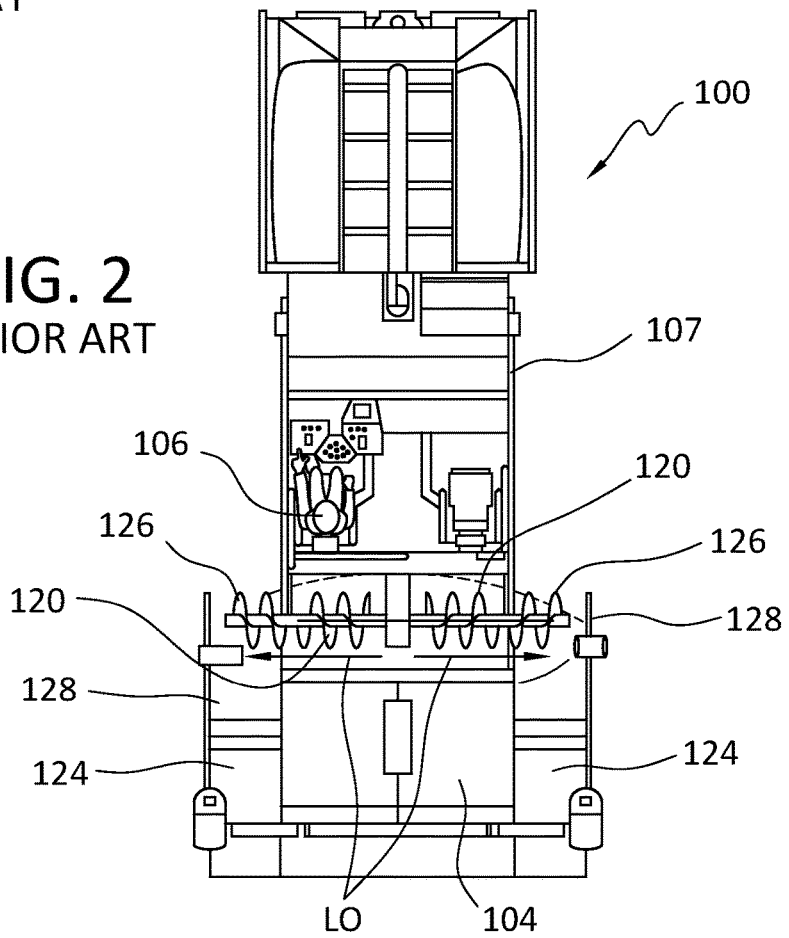
FIG. 2 PRIOR ART
FIG. 2 is a schematic top plan of the conventional, PRIOR ART paver or paving machine as illustrated within FIG. 1 wherein it is seen the screed assembly comprises a centrally located main or primary screed assembly, a pair of auxiliary or side extension screed assemblies which extend transversely and outwardly from left and right sides of the main or primary screed assembly, and a plurality of horizontally oriented augers for distributing the asphalt material transversely.

Referring now to the drawings, and more particularly to FIGS. 1-3, a typical or conventional PRIOR ART paver or paving machine is disclosed and is seen to comprise a tractor and a screed assembly wherein the paver is disclosed and is generally indicated by the reference character 100, while the tractor is disclosed at 102 and the screed assembly is disclosed at 104. A driver 106 is seated within a cab 107 of the tractor 102 so as to drive the tractor 102 in a direction of travel DOT, and a pair of tow bars 108, only one of which is visible, are disposed upon opposite sides of the tractor and are connected to the screed assembly 104 so as to tow the screed assembly 104 behind the tractor 102 as the tractor moves along the roadway, road surface, parking, or the like 110 such that the screed assembly 104 can lay down a new, fresh surface of pavement 112. In order to accomplish this, a truck 114, carrying a supply of fresh asphalt, moves ahead of the tractor 102 and delivers a supply of fresh asphalt 116 onto a pair of endless conveyors 118 which are located beneath the cab 107 of the tractor 102, wherein the upper run of the endless conveyors 118 conveys the asphalt material in the aft direction toward a pair of augers 120,120 which extend laterally outwardly in opposite directions from the centerline of the paver 100 as can best be seen in FIG. 2. The augers 120,120 move the freshly supplied asphalt material 116 laterally outwardly, as schematically illustrated by the arrows LO, LO, so that the asphalt material 116 is effectively deposited in a pile 122 in front of the screed assembly 104 whereby the screed assembly 104, which conventionally comprises a solid screed block, will lay down a new, fresh pavement of asphalt material which will have a predetermined thickness dimension depending upon the angle of attack of the lower forward edge portion of the screed assembly 104.

As is also common with conventional pavers 100, a pair of extension screeds 124,124 are provided upon opposite sides of the main or primary screed assembly 104 such that greater widths of new roadway or parking lots can be paved as the tractor 102 and the screed assemblies 104,124 traverse a single pass along the roadway or parking lot. Typically, the main screed may be approximately six to eight feet (6-8') wide while the extension screeds may be, for example, three to four feet (3.4') wide such that the entire screed assembly may be approximately fourteen feet (14') wide. If such extension screeds 124,124 are utilized, it is noted that a pair of auxiliary augers 126,126 are mounted upon opposite ends of the main augers 120,120 such that the auxiliary augers 126,126 are coaxially arranged with the main augers 120, 120, are driven by the same motor drive utilized to drive the main augers 120,120, and are adapted to receive asphalt material from the main augers 120,120 and subsequently distribute the asphalt material in front of the pair of extension screeds 124,124. To complete the paver assembly 100, a pair of oppositely disposed end gates 128,128 are provided upon opposite sides of the screed assembly 104 so as to prevent asphalt material from moving beyond the lateral extents of the main or primary screed 104 or the lateral extents of the extension screeds 124,124 when the extension screed 124,124 are employed. The end gates 128,128 are mounted upon the extension screeds 124,124 so as to permit the extension gates 128,128 to move laterally outwardly as needed or laterally inwardly as needed, depending upon whether or not the extension screeds 124,124 are moved laterally outwardly or inwardly. As will become clearer from the description of the present invention presented later in this specification, the extension screeds 124,124 and the main or primary screed 104 are not coaxially aligned with respect to each other so that the main or primary screed 104 does not interfere with the movement of the extension screeds 124,124 inwardly and outwardly.

With reference now being made to FIG. 3, which is effectively an enlarged view of the paver 100 as disclosed within FIG. 1 so as to clearly show components of the paver 100 which can be utilized to alter the angle of attack of the lower forward edge portion of the screed assembly 104, it is to be noted that forward ends 130 the tow bars 108 are pivotally connected to the tractor 102 by means of pivotal connections 132, only one of which is shown, while the opposite rear ends of the tow bars 108 are fixedly connected to the screed assembly 104 by means of downwardly extending arms 134. In addition, it is also to be noted that the forward end 130 of each tow bar 108, within which the pivotal connection 132 is defined, is adapted to be connected to a suitable actuator, not shown, wherein the end 130 of each tow bar 108 can be moved vertically upwardly and downwardly as schematically illustrated by the up and down arrows U, D.

Accordingly, it can be appreciated that as the actuators, not shown, move the forward ends 130 of the tow bars 108 upwardly or downwardly, the fixed connections defined between the tow bars 108 and the screed assembly 104 can alter the angle of attack a of the lower forward edge portion of the screed assembly 104. Still yet further, a manual or hand crank 136 is rotatably mounted upon upon an upper end portion of an upstanding mounting plate 138 which has its lower end portion pivotally mounted to the screed assembly 104 by means of a pivotal connection 140, while the manual or hand crank 136 is mounted upon a first externally threaded screw rod 142 which is fixedly connected to one end of a turnbuckle or sleeve member 144 which is threadedly engaged upon a first end of a second externally threaded screw rod 146 while the second end of the second externally threaded screw rod 146 is fixedly connected to one of the tow bars 108. Accordingly, depending upon which direction the manual or hand crank 136 is rotated, it causes the sleeve member 144 to travel leftwardly or rightwardly upon the second externally threaded screw rod 146 thereby causing the upstanding mounting plate 138 to pivotally move around the pivotal connection 140 in order to similarly adjust the angle of attack a of the lower forward edge portion of the screed assembly 104. Considered from different perspectives, the upward and downward movement of the ends 130 of the tow bars 132 may be considered to impart adjustments to the angle of attack a of the screed assembly 104, in order to follow grade, often using automatic grade controls and the hand crank system while the hand crank system imparts adjustments to the angle of attack a of the screed assembly 104 in order to make the mat thickness adjustment.

While it can therefore be readily appreciated that conventional screed assemblies 104 can be adjusted such that their lower forward edge portion will be disposed at different angles of attack a so as to effectively produce the desired mat thickness and float over the paving material passing there beneath and form a newly paved surface, wherein such paved surface or mat will exhibit one relative consistent density, it is also readily appreciated that conventional screed assemblies 104 cannot be adjusted at specific locations across the entire lateral width of the screed assemblies so as to in fact permit more or less asphalt material to pass beneath the specific regions or locations of the screed assembly 104 so as to provide, for example, an increased mat density over depressions within the roadway being repaved wherein, for the reasons fully discussed hereinbefore, good roller compaction is facilitated throughout the paved roadway or parking lot such that a uniform final density is achieved which is critically important to the structural integrity of the newly paved roadway or parking lot, whereby the newly paved roadway or parking lot will also exhibit enhanced durability thereby eliminating the need to repave the roadway or parking lot more often.

Figure 6:
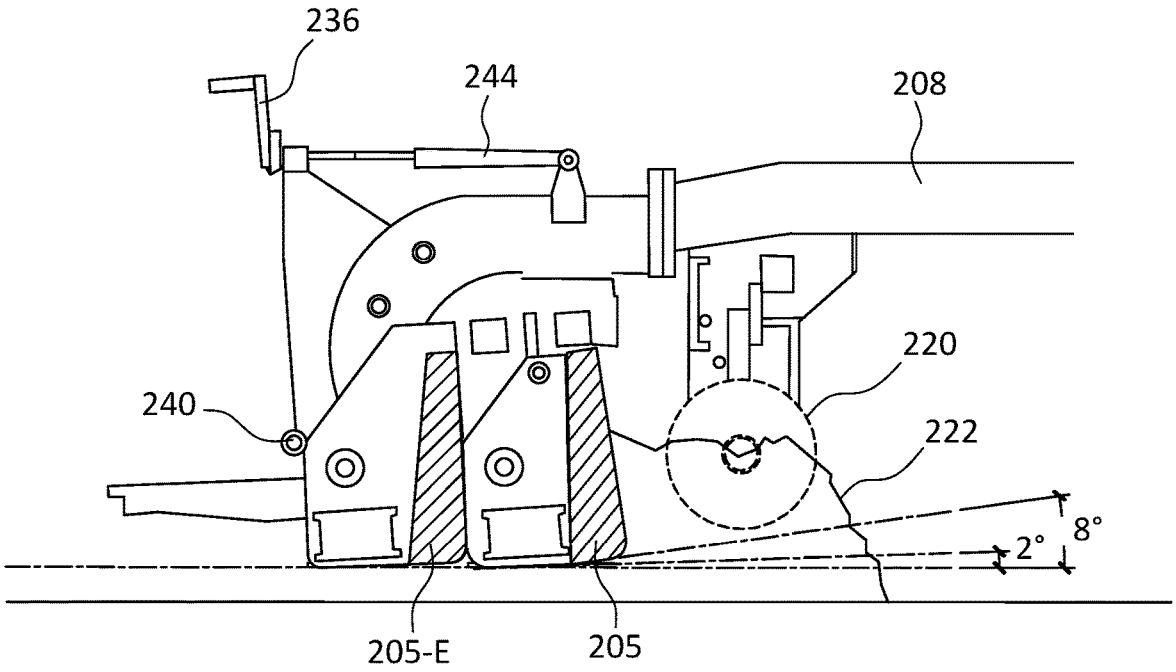
FIG. 6 is a schematic, cross-sectional view of the new and improved screed assembly as disclosed within FIG. 4 showing the disposition of any one of the screed components or segments of the screed assembly when the particular one of the screed components or segments is disposed at an angle of attack, of for example, 8° with respect to the underlying road surface or parking lot.
Figure 7:
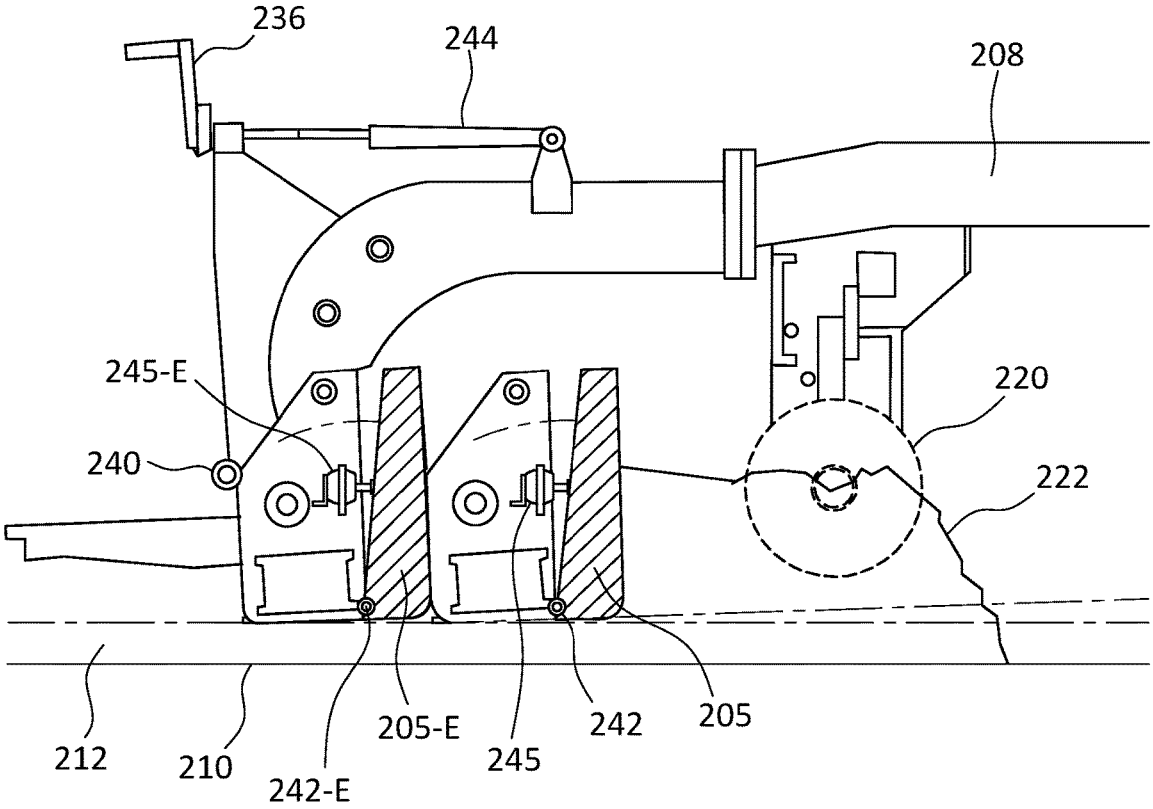
FIG. 7 is a schematic cross-sectional view of the new and improved screed assembly as disclosed within FIGS. 5 and 6 wherein the plurality of adjacent screed components or segments, mounted upon the screed assembly has a plurality of pneumatic actuators operatively associated with each one of the screed components or segments comprising both the main screed assembly and the auxiliary or side extension screed assemblies.
Figure 8:
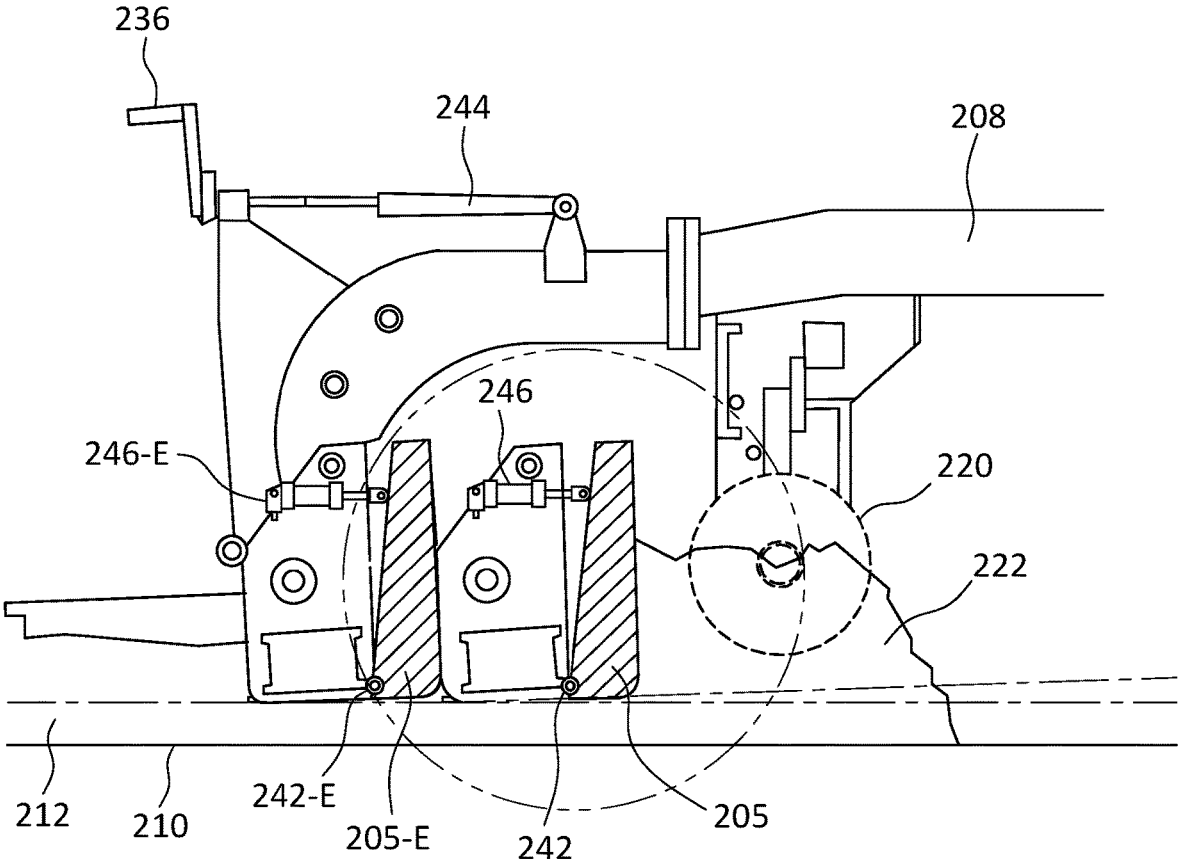
FIG. 8 is a schematic cross-sectional view of the new and improved screed assembly as disclosed within FIGS. 5 and 6 wherein the plurality of adjacent screed components or segments, mounted upon the screed assembly has a plurality of hydraulic piston-cylinder actuators operatively associated with each one of the screed components or segments comprising both the main screed assembly and the auxiliary or side extension screed assemblies.

With reference therefore now being made to FIG. 4 of the drawings, there is disclosed a new and improved screed assembly as constructed in accordance with the principles and teachings of the present invention and as denoted by the reference character 204. It is to be noted that whenever the new and improved screed assembly 204 is discussed, or whenever the new and improved screed assembly 204 as mounted upon the tractor components of a paver corresponding to the paver disclosed within FIGS. 1-3, all components of the new and improved screed assembly 204, or the tractor components of the corresponding paver, which correspond to the various component parts of the convention paver 100 as disclosed within FIGS. 1-3, will be denoted by corresponding reference characters except that they will be within the 200 series. Therefore, with particular reference being made to FIG. 4, it is seen that, in accordance with the principles and teachings of the present invention, the new and improved screed assembly 204 comprises a plurality of screed components or segments 205 wherein each component or segment 205 has the configuration which is substantially that of a rectangular parallelepiped, that the plurality of screed components or segments 205 are disposed adjacent to each other and extend in a serial manner within a horizontally extending array, and that each one of the screed components or segments 205 is individually and independently movable in a pivotal manner by means of a pivotal connection 242 located along the rear edge portion of each screed component or segment 205, as can best be seen in FIGS. 7 and 8, such that the angle of attack a of the lower, forward edge portion of each screed component or segment 205 can be altered or adjusted as required or desired in order to create a larger entry area for the asphalt material beneath that particular one of the plurality of screed components or segments 205. Such an adjustment, as shown within FIGS. 5 and 6, can be, for example, between 2° and 8°.

Figure 8A:
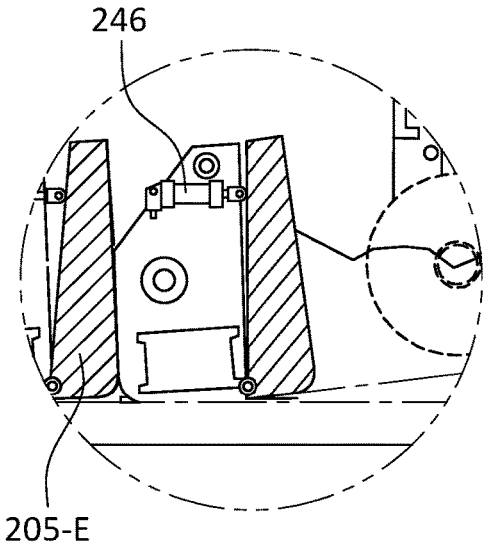
FIG. 8*a* is a schematic view of the encircled region 8*a* as noted within FIG. 8 wherein the hydraulic piston-cylinder actuators are disposed at their retracted positions such that the lower front edge portions of the screed components or segments are disposed at a relatively large angle of attack.

Each one of the screed components or segments 205 may also have a width dimension of approximately six inches (6"), although the components or segments may be provided with different width dimensions as may be desired or required, and it is additionally noted, within FIG. 4, that the first or leftwardmost one of the plurality of screed components or segments 205 has been actuated such that it effectively has a greater angle of attack a than those of the remaining screed components or segments. It is also noted that in connection with the foregoing structural components, the screed components or segments of the screed extensions have been noted by the reference character 205-E. It is lastly noted with reference being made to FIGS. 7, 8, and 8*a*, that in order to achieve the pivotal movement of the individual screed components or segments 205,205E, each individual screed component or segment 205,205 is provided with a suitable actuator which, as disclosed within FIG. 7, comprises a pneumatic cylinder 245 connected to a rear or back wall surface portion of the component or segment 205, while in FIG. 8, the actuators may comprise hydraulically actuated piston-cylinder assemblies 246,246-E. In FIG. 8*a*, it is noted that the piston of the piston-cylinder assembly 246 has been retracted, thereby effectively pulling the particular screed component or segment 205 rearwardly, causing the screed component or segment to pivot around the pivotal connection 242 and thereby effectively increasing the angle of attack a of the lower forward edge portion of the screed component or segment 205.

Figure 9:
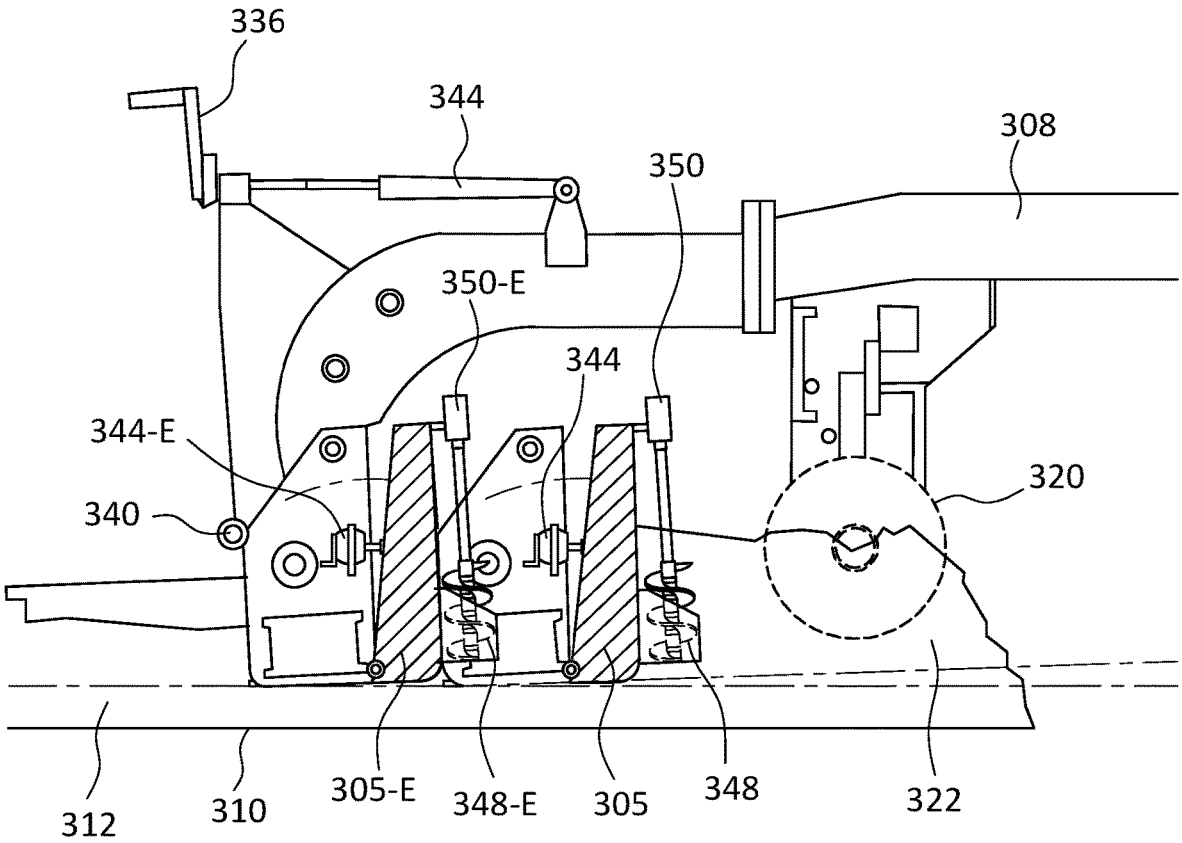
FIG. 9 is a schematic view similar to that of FIG. 8 showing, however, a second embodiment of the screed assembly constructed in accordance with the principles and teachings of the present invention and wherein a plurality of vertically oriented augers are respectively operatively associated with each one of the screed components or segments of both the main screed assembly and one of the extension screed assemblies so as to enhance the density of the asphalt material just prior to the asphalt material being passed beneath the plurality of screed components or segments and fixedly laid down upon the roadway or parking lot being repaved.
Figure 10:
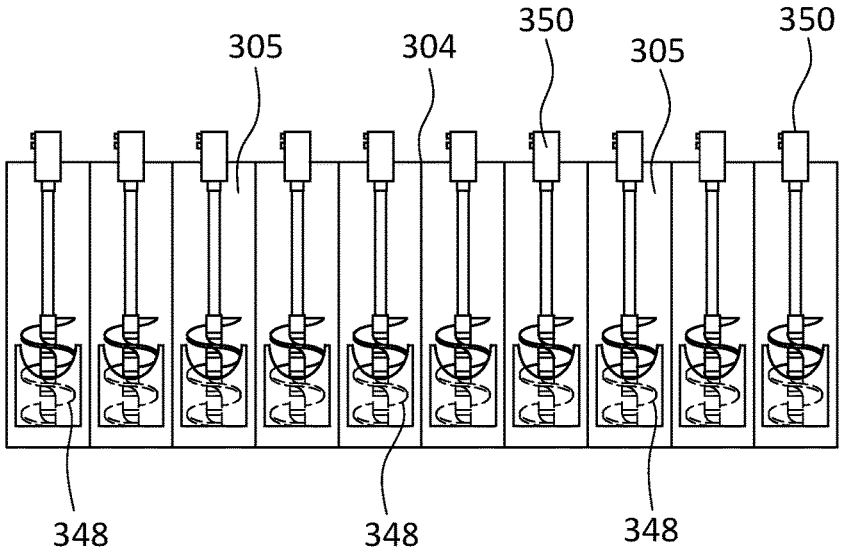
FIG. 10 is a schematic front elevational view of the second embodiment of the screed assembly as shown in FIG. 9 wherein the plurality of vertically oriented augers are respectively disposed in front of the plurality of screed components or segments of the main screed assembly so as to enhance the density of the asphalt material just prior to the asphalt material being passed beneath the plurality of screed component or segments and fixedly laid down upon the roadway or parking lot being repaved.

With reference now being made to FIGS. 9 and 10, there is disclosed a second embodiment of a screed assembly 304 which has been constructed in accordance with the principles and teachings of the present invention and wherein the second embodiment screed assembly likewise comprises a plurality of screed components or segments 305. It is to, be noted that whenever the new and improved screed assembly 304 is discussed, or whenever the new and improved screed assembly 304 as mounted upon the tractor components of a paver corresponding to the paver disclosed within FIGS. 1-3, all components of the new and improved screed assembly 304, or the tractor components of the corresponding paver, which correspond to the various component parts of the convention paver 100 as disclosed within FIGS. 1-3, will be denoted by corresponding reference characters except that they will be within the 300 series. With continued reference therefore being made to FIGS. 9 and 10, it is seen that in conjunction with each one of the screed components or segments 305,305-E of the main or primary screed assembly or one of the extension screed assembly, a plurality of vertically oriented augers 348 are disposed in front of each one of the screed components or segments 305 of, for example, the main or primary screed assembly 304 such that when one or more augers 348 are respectively actuated, the augers 348 will impart a downward compressive force upon the asphalt material passing beneath the plurality of screed components or segments 305 in the desired area so as to therefore serve to enhance the density of the asphalt material just prior to the asphalt material being passed beneath the plurality of screed components or segments 305 and fixedly laid down upon the roadway or parking lot being repaved by means of the screed components or segments 305. It is lastly noted that each auger 348 is adapted to be driven by means of a suitable motor 350 which may be, for example, a hydraulic motor.

Figure 11:
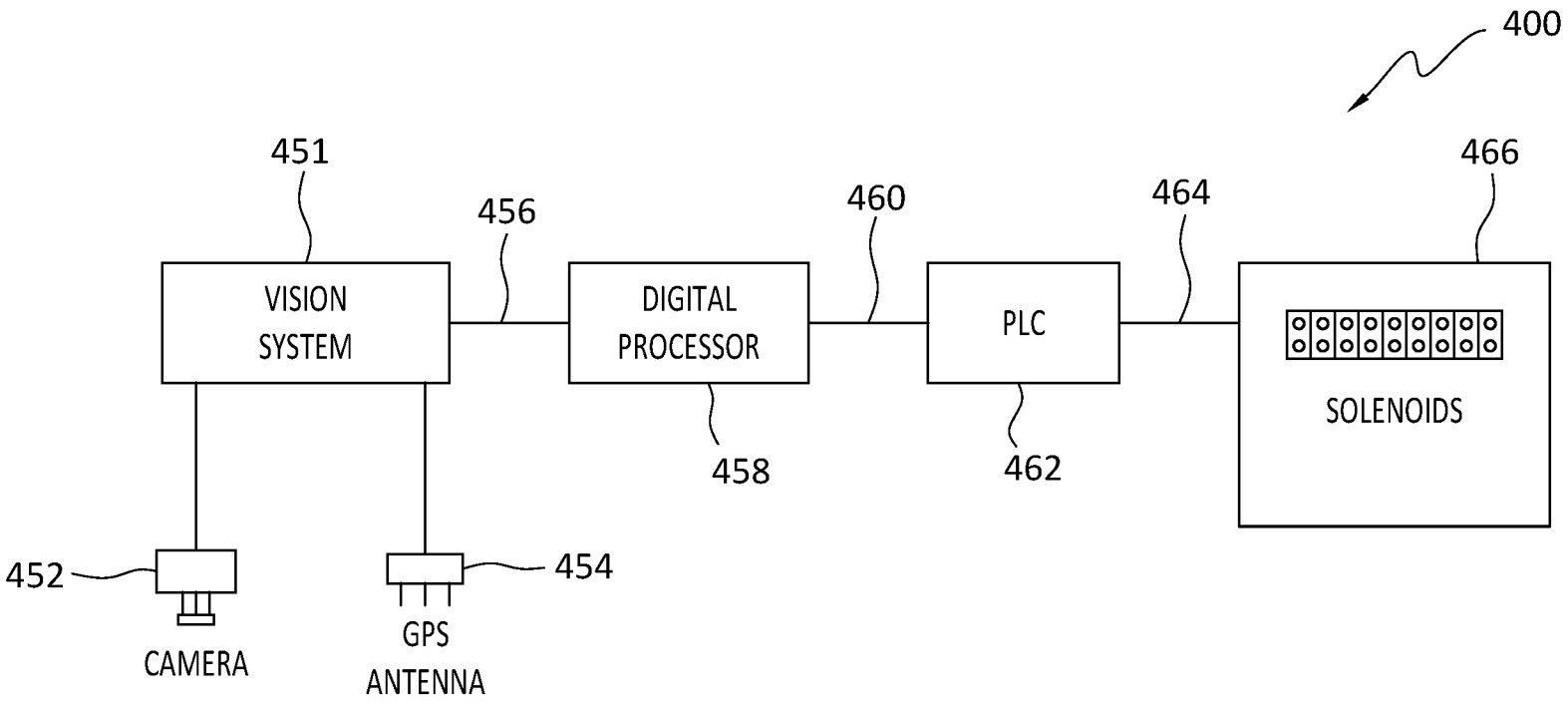
FIG. 11 is a schematic block diagram of a control system which illustrates how the forward-looking vision system of the new and improved screed assembly of the present invention is utilized to detect the presence and location of ruts, depressions, tracks, or potholes within the roadway or parking lot, and how to accordingly accurately actuate one or more of the screed components or segments in order to alter the angle of attack of the front lower edge portion of the one or more of the screed components or segments.

With reference lastly being made to FIG. 11, there is illustrated a schematic block diagram of a control system which comprises a forward-looking vision system 451 to be utilized in conjunction with the new and improved screed assembly of the present invention so as to detect the presence and location of ruts, depressions, tracks, or potholes within the roadway or parking lot ahead of the paver whereby one or more of the screed components or segments will be actuated in order to alter the angle of attack of the front lower edge portion of the one or more of the screed components or segments 305 in order to facilitate an enlarged area in which asphalt material entering under the one or more of the screed components or segments 305 in order to produce an area of increased mat density over the depressions, ruts, tracks, or potholes within the roadway or parking lot, the control system being generally indicated by the reference character 400. More particularly, the vision system comprises at least one camera component 452 and one global positioning system (GPS) component or antenna 454 so as to be capable of visually detecting ruts, depressions, tracks, or potholes within those portions of the roadway or parking lot that are located in front of the paver or paving machine and which are to be repaved.

The data derived from the camera 452 and the global positioning system (GPS) 454 is then transmitted by transmission line 456 as signals to a digital processor 458 which effectively digitally maps the dimensions and locations of all of the depressions, ruts, tracks, and potholes within the roadway ahead or in front of the approaching paver or paving machine. Signals from the digital processor 458 are, in turn, transmitted as signals along a transmission line 460 to a programmable logic controller (PLC) 462 which, in turn, generates desired output signals, along transmission line 464, to a suitable bank or assembly of solenoid-controlled valves 466 which are operatively associated with each one of the various pneumatic or hydraulic actuators 245,245-E,246,246-E, as well as the vertically oriented augers 348,348-E, so as to achieve the respective operations of the various screed components or segments 205,205-E, 305,305E, as well as the vertically oriented augers 348,348-E, in order to achieve the proper deposition of the asphalt material onto the roadway or parking lot being repaved. More particularly, particular ones of the plurality of screed components or segments 205,205-E,305,305-E can be pivotally actuated for movement within their respective vertically oriented planes, by means of the pneumatic or hydraulic actuators 245,245-E,246,246-E, so as to alter the forward-facing angles of attack of the particular ones of the plurality of the screed components or segments 205,205-E, 305,305-E and thereby permit an increase in mat density to be deposited at predetermined times and locations onto the underlying roadway or parking lot in order to allow achievement of good final density even though a lesser value of compaction ratio will occur over the depression, rut, track, or pothole during the rolling operation. As has been noted, each one of the screed segments or components 205,205-E, 305,305-E can be individually and independently movable with respect to the other screed segments or components 205,205-E,305,305-E, however, by suitable actuation of the pneumatic or hydraulic actuators 245,245-E,246,246-E, as well as the augers 348,348-E in conjunction with the movable screed segments 205,205E,305,305E, or by themselves by means of the hydraulic motors 350,350-E, in response to signals from the vision system 451, more than one, or a plurality of the screed segments or components 205,205-E may be simultaneously actuated in response to the asphalt deposition needs as determined by means of the vision system 451.

It is to be particularly noted that when repaving a roadway, road surface, or parking lot, in those regions where there are no depressions, ruts, tracks, or potholes, a fresh amount of asphalt material is laid down with a depth of two and one half inches (2.5") because after rolling the fresh asphalt by means of a conventional roller, the finalized depth of the roadway or road surface or parking lot will be two inches (2.0"), wherein the paved mat has been compacted form an initial height of 2.5" down to 2.0" and would have been compacted by a ratio of 0.25 inches per inch. However, if, for example, there is a pothole present within the roadway or road surface being repaved, and the pothole has a depth of, for example, one half inch (0.5"), then the amount of fresh asphalt material to be laid down atop the pothole will be three inches (3.0") because one half inch (0.5") of the fresh asphalt material will be used to fill the pothole, leaving a residual amount of two and one half inches (2.5") above the pothole. If the roller bridges across the pothole, the 3.00" will be compacted down to 2.5" which equals a compaction ratio of 0.20 inches per inch. As can therefore be readily appreciated, as a result of the development of the new and improved screed assembly 204 of the present invention, individual ones of the plurality of screed components or segments 205 may be pivotally tilted rearward so as to effectively raise the lower front edge portion of the particular screed component or segment 205 which increases the angle of attack so as to permit a relatively larger amount of asphalt material to pass thereunder when such a relatively larger amount of asphalt material is needed to produce a mat of increased density over the depressions, ruts, tracks, or potholes within the roadway, road surface, or parking lot being repaved such that these areas which will inherently experience a lower value of compaction ratio will then achieve good final density after rolling.

Obviously, many variations and modifications of the present invention are possible in light of the above teachings. It is therefore to be understood that within the scope of the appended claims, the present invention may be practiced otherwise than as specifically described herein.

REFERENCE NUMBER KEY

100—Conventional road paving machine or paver
102—Tractor of machine or paver 100
104—Screed assembly of machine or paver 100
106—Driver of machine or paver 100
107—Cab of tractor 102
108—Tow arms connecting the screed assembly to the tractor of paver 100
110—Road surface to be repaved
112—Newly repaved road surface
114—Truck for supplying fresh asphalt material
116—Mass of asphalt material supplied to front of tractor 102
118—Endless conveyor of tractor conveying asphalt material aft
120—Horizontally oriented augers for conveying asphalt material laterally
122—Pile of new asphalt discharged by conveyor 118 ahead of screed 104
124—Side extension screeds
126—Side extension augers
128—End gates
130—Forward end of two arm 108
132—Pivotal connection of tow arm 108 to tractor
134—Downwardly extending rear end of tow arm 108
136—Hand crank assembly for adjusting angle of attack of screed assembly
138—Upstanding mounting plate connecting screed to hand crank assembly
140—Lower pivotal connection of mounting plate 138
142—First screw-threaded rod
144—Turnbuckle
146—Second screw-threaded rod
DOT—Direction of Travel
U—Up arrow indicating upward adjustment of tow bar end 130
D—Down arrow indicating downward adjustment of tow bar end 130
α—Angle of attack
204—New screed assembly
205—Individual screed components or segments of screed assembly 204
205-E—Individual screed component or segment of extension screed
242, 242-E—Lower pivotal connections of screed components or segments
245, 245-E—Pneumatic actuators for screed components or segments
246, 246-E—Hydraulic actuators for screed components or segments
348—Vertically oriented augers for use in conjunction with screed segments
350—Hydraulic motors for augers 348
451—Vision system
452—Camera of vision system
454—GPS system of visual system
456—Signal transmission line from vision system to digital processor
458—Digital processor
460—Signal transmission line from digital processor to PLC
462—Programmable logic controller (PLC)
464—Signal transmission line from PLC to solenoid control valve assembly
466—Solenoid controlled valve assembly

What is claimed as new and desired to be protected by Letters Patent, is:

1. A screed assembly for a road paving machine used for repaving a road surface, having a predetermined width dimension, with new paving material, comprising:

a plurality of vertically oriented screed segments disposed adjacent to each other in a horizontally extending array;

wherein each one of said plurality of screed segments is individually and independently movable within a vertical plane and pivotally movable around a horizontally extending axis located at a first predetermined location upon each one of said plurality of screed segments; and a plurality of single actuators respectively connected to each one of said plurality of screed segments, at a second predetermined location which is vertically offset from said horizontally extending axis located at said first predetermined location, for pivotally moving individual ones of said plurality of screed segments within said vertical planes and around said horizontally extending axis located at said first predetermined location upon each one of said plurality of screed segments, depending upon the extent to which each one of said plurality of single actuators is extended or retracted, such that a lower, front edge portion of a particular screed segment can be pivotally adjusted in an angular manner within its vertical plane so as to alter its angle of attack and thereby permit a predetermined amount of new paving material to pass beneath said lower, front edge portion of said particular screed segment in order to vary the amount of new paving material passing beneath said lower, front edge portion of said particular screed segment whereby the density of the new paving material, comprising the newly paved road surface, will be changed such that when the newly paved road surface is rolled, the resulting density of the newly paved rolled road surface will be substantially constant throughout its width dimension regardless of ruts, tracks, depressions, or potholes present within the original road surface being repaved.

2. The screed assembly as set forth in claim 1, wherein:

said plurality of screed segments are pivotally mounted at lower rear end portions upon said screed assembly so as to achieve said predetermined angle of attack.

3. The screed assembly as set forth in claim 1, wherein:

each one of said plurality of screed segments has the configuration which is substantially that of a rectangular parallelepiped.

4. The screed assembly as set forth in claim 3, wherein:

each one of said plurality of screed segments, having said configuration which is substantially that of a rectangular parallelepiped, is approximately six inches (6") wide.

5. The screed assembly as set forth in claim 1, wherein:

said plurality of actuators comprise pneumatic actuators.

6. The screed assembly as set forth in claim 1, wherein:

said plurality of actuators comprise hydraulic piston-cylinder assemblies.

7. The screed assembly as set forth in claim 1, further comprising:

a vision system for visually detecting the presence of ruts, tracks, depressions, or potholes within the road surface ahead of the screed assembly such that individual ones of said plurality of screed segments can have its angle of attack adjusted in order to predetermine the amount of new paving material which can pass under said lower, front edge portions of said individual ones of said plurality of screed segments which have had their angles of attack adjusted in order to vary the amount of new paving material passing under said lower, front edge portions of said adjusted screed segments whereby the density of the new paving material comprising the newly paved road surface will substantially be constant regardless of ruts, tracks, depressions, or potholes present within the road surface being repaved.

8. The screed assembly as set forth in claim 7, wherein said vision system comprises:

a camera and a GPS system for detecting the presence and location of depressions, ruts, tracks, or potholes within the road surface being repaved;

a digital processor for using data from said camera and GPS system for digitally mapping the dimensions and locations of the depressions, ruts, tracks, or potholes within the road surface being repaved;

a programmable logic controller (PLC) for outputting signals to control said individual ones of said plurality of screed segments; and a plurality of solenoid-controlled valves for controlling fluid to said actuators operatively connected to said individual ones of said plurality of screed segments in order to actuate said individual ones of said plurality of screed segments such that said individual ones of said plurality of screed segments will achieve their desired movements and angles of attack.

9. The screed assembly as set forth in claim 1, wherein:

more than one of said plurality of screed segments may be actuated simultaneously.

10. A road paving machine used for repaving a road surface, having a predetermined width dimension, with new paving material, and having a screed assembly mounted thereon, wherein said screed assembly comprises:

a plurality of vertically oriented screed segments disposed adjacent to each other in a horizontally extending array, wherein each one of said plurality of screed segments is individually and independently movable within a vertical plane and pivotally movable around a horizontally extending axis located at a first predetermined location upon each one of said plurality of screed segments; and a plurality of single actuators respectively connected to each one of said plurality of screed segments, at a second predetermined location vertically offset from said horizontally extending axis located at said first predetermined location, for pivotally moving individual ones of said plurality of screed segments within said vertical planes and around said horizontally extending axis located at said first predetermined location upon each one of said plurality of screed segments, depending upon the extent to which each one of said plurality of single actuators is extended or retracted such that a lower, front edge portion of a particular screed segment can be pivotally adjusted in an angular manner within its vertical plane so as to alter its angle of attack and thereby permit a predetermined amount of new paving material to pass beneath said lower, front edge portion of said particular screed segment in order to vary the amount of new paving material passing beneath said lower, front edge portion of said particular screed segment whereby the density of the new paving material, comprising the newly paved road surface, will be changed such that when the newly paved road surface is rolled, the resulting density of the newly paved rolled road surface will be substantially constant regardless of ruts, tracks, depressions, or potholes present within the original road surface being repaved.

11. The paving machine as set forth in claim 10, wherein: said plurality of screed segments are pivotally mounted at lower, rear end portions upon said screed assembly so as to achieve said predetermined angle of attack.

12. The paving machine as set forth in claim 10, wherein: each one of said plurality of screed segments has the configuration which is substantially that of a rectangular parallelepiped.

13. The paving machine as set forth in claim 12, wherein: each one of said plurality of screed segments, having said configuration which is substantially that of a rectangular parallelepiped, is approximately six inches (6") wide.

14. The paving machine as set forth in claim 10, wherein: said plurality of actuators comprise pneumatic actuators.

15. The paving machine as set forth in claim 10, wherein: said plurality of actuators comprise hydraulic piston-cylinder assemblies.

16. The paving machine as set forth in claim 10, further comprising:

a vision system for visually detecting the presence of ruts, tracks, depressions, or potholes within the road surface ahead of the screed assembly such that individual ones of said plurality of screed segments can have its angle of attack adjusted in order to predetermine the amount of new paving material which can pass under said lower, front edge portions of said individual ones of said plurality of screed segments which have had their angles of attack adjusted in order to vary the amount of new paving material passing under said lower, front edge portions of said adjusted screed segments whereby the density of the new paving material comprising the newly paved mat will be increased in the area of the ruts, tracks, depressions, or potholes present within the road surface being repaved.

17. The screed assembly as set forth in claim 16, wherein said vision system comprises:

a camera and a GPS system for detecting the presence and location of depressions, ruts, tracks, or potholes within the road surface being repaved;

a digital processor for using data from said camer and GPS system for digitally mapping the dimensions and locations of the depressions, ruts, tracks, or potholes within the road surface being repaved;

a programmable logic controller (PLC) for outputting signals to control said individual ones of said plurality of screed segments; and a plurality of solenoid-controlled valve for controlling fluid to actuators operatively connected to said individual ones of said plurality of screed segments in order to actuate said individual ones of said plurality of screed segments such that said individual ones of said plurality of screed segments will achieve their desired movements and angles of attack.

18. The screed assembly as set forth in claim 10, wherein: more than one of said plurality of screed segments may be actuated simultaneously.

19. A method of using a modified free floating paving screed that can apply a paved mat of different material densities, to pave a road surface which has planar areas and depressions located therewithin, comprising the steps of:

depositing roadway material onto the road surface to be repaved wherein a first predetermined material density of roadway material is deposited upon first areas of the road surface that do not have depressions located therewithin and wherein said areas are inherently accessible to effective compaction, and wherein a second predetermined material density of roadway material, greater than said first predetermined material density roadway material, is deposited upon second areas of the road surface that do have depressions located therewithin, wherein said areas inherently afford reduced accessibility to effective compaction compared to said first areas of the road surface that do not have depressions located therewithin; and moving at least one roller over the road surface so as to compress and compact the roadway material comprising the first and second predetermined mat densities of roadway material respectively located upon the first areas of the road surface that do not have depressions located therewithin and the second areas of the road surface that have depressions located therewithin, whereby the finalized compaction density of the roadway material, compressed and compacted onto the first and second areas of the road surface as a result of the roller moving over the first and second areas of the road surface will be uniform as a result of said second predetermined mat density of roadway material, which is greater than said first predetermined mat density of roadway material, said area of greater material density receiving a requisite increase in mass such that finalized compaction density is achieved irrespective of the inherent lesser effective compaction ratio that said area of road surface depression located therewithin will receive.

20. The method as set forth in claim 19 above, wherein:

the topography of said first areas of the road surface are mostly planar, and the new road surface material applied thereon forms an additional depth of material above it and is substantially planar;

the topography of said second area of the road surface consists of a recess and the material applied thereon both fills said recess and similarly forms an additional depth of new material above it;

wherein the ability of a subsequent rolling operation to compact material of said first area and second area will be constrained by both the topography of the road and the dimensional characteristics of the roller drum such that the degree of compaction that can be applied will meet the requirements of the height of material and density of material over said first area, said degree of compaction being controlled by the first area, producing good final density therein;

wherein the degree of compaction applied as controlled by the first area will be insufficient to produce good final density over said second area due to the increased total height of material when using said density of material applied thereon; and wherein laying a higher density mat over said second area only, the degree of compaction applied as controlled by the first area then becomes sufficient to achieve good final density in both the first and second areas of the new road surface.

21. The method as set forth in claim 19, wherein:

the first and second predetermined densities of fresh roadway material are respectively deposited upon the first and second areas of the road surface by a screed assembly comprising a plurality of screed segments disposed adjacent to each other in a horizontally extending array, wherein each one of said plurality of screed segments is individually and independently movable within a vertical plane such that a lower, front edge portion of a particular screed segment can be vertically adjusted so as to alter its angle of attack and thereby predetermine the amount of fresh paving material which can pass under said lower, front edge portion of said particular screed segment in order to vary the amount of fresh paving material passing under said lower, front edge portion of said particular screed segment, whereby the density of the newly paved mat comprising the repaved road surface will be increased over the ruts, tracks, depressions, or potholes present within the road surface being repaved.

* * * * *